United States Patent [19]

Conn

[11] 4,022,374

[45] May 10, 1977

[54] ADJUSTABLE ENVELOPE

[76] Inventor: John L. Conn, c/o George Spector, 3615 Woolworth Bldg., 233 Broadway, New York, N.Y. 10007

[22] Filed: July 1, 1975

[21] Appl. No.: 592,186

[52] U.S. Cl. ..... 229/68 R; 229/72; 229/DIG. 9

[51] Int. Cl.[2] ..... B65D 27/00

[58] Field of Search ..... 229/56, 68 R, 72, DIG. 7, 229/9, 19, 80; 220/8

[56] References Cited

UNITED STATES PATENTS

| | | | |
|---|---|---|---|
| 1,514,371 | 11/1924 | Clough | 229/68 R |
| 2,361,984 | 11/1944 | Williamson | 229/19 |
| 3,004,659 | 10/1961 | Usher et al. | 206/313 |
| 3,063,618 | 11/1962 | Berkowitz | 229/68 R |
| 3,332,550 | 7/1967 | Sejman | 229/72 |
| 3,876,134 | 4/1975 | Rice et al. | 229/68 R |

*Primary Examiner*—William Price
*Assistant Examiner*—Bruce H. Bernstein

[57] ABSTRACT

The invention comprises a pair of smaller envelopes which can be joined together at adjacent open ends to form a larger envelope of varying sizes, wherein each smaller envelope can be individually sealed to form smaller individual envelopes or can be adjustably interlocked to form the larger envelope.

1 Claim, 8 Drawing Figures

4
5
1
2
8
2A
9
13
7
7A
LEFT
10
3
3A
6A
14
6
RIGHT

ADJUSTABLE ENVELOPE

This invention relates to the common paper envelope that is used to contain an item for shipment or mailing wherein the envelope is constructed from a right handed and also a left handed envelope wherein the right handed envelope will insert inside the left handed envelope and sealed together so as to construct an even or longer single envelope.

A principal object of this invention is to provide an envelope having two open areas at right angles to each other that are unsealed in the open condition and which can be sealed to form a complete envelope or joined adjustable with a similar envelope to form a larger of varying size.

Another object of the present invention is to provide an adjustable envelope that is simple in design, inexpensive to make, rugged in construction, easy to use and efficient in operation.

These and other objects will be readily evident upon a study of the following specifications and the accompanying drawings wherein:

FIG. 1 is a flat view of a pre-cut piece of paper that is cut or shaped in the design of a left handed un-folded envelope. All areas that are shown, or that is visible as shown, will thus be the inside areas of the envelope when the envelope is folded and sealed, wherein the lower extended flat or wing area of the envelope 3 will fold up 180° at the marked creased area 10 so as to join the flat base surface 1 at the pressed or creased area 9 wherein the left side wing or flap 2 will fold 180° to the right of the creased area 8 so as to join the flat base area 1 but will rest on the wing flap 3 back surface and this wing flap 2 will then be glued to this back surface wing flap of 3 at the glued areas (2A and 3A) wherein this will complete one envelope assemly with the sealing ends of (6 and 6A, and 4 and 5) un-sealed wherein these two sealing ends will remain as part of the finished envelope. When the envelope is used as a single envelope, the sealing flat 4 will thus fold forward at the creased area 9 to 180° so as to rest on the back surface of flap 2 and are sealed together at the glued areas of flap 5 joining the back flap area of flap 2 and sealed by the glued area 5 wherein the sealing flap area on the right side (6 and 6A) will be folded backward 180° to be sealed to the back surface of area 1 at the glued area 13 wherein this will completely seal this one envelope. In other words, (6A) will seal to the back area of the base 1 at area 13.

FIG. 2 is a view of a pre-cut piece of paper that is cut (flat view) or shaped in the design of the one right handed un-folded envelope. All areas that are shown, or that is visible, will thus be the inside areas of the envelope when the envelope is folded and sealed, wherein this envelope will be folded as per the same explaination as quoted in FIG. 1 but the end sealing flap (7 and 7A) will thus fold forward 180° to seal the flap 7 to the back surface of flap 3 by the glued area 7A.

Figures 5, 6:
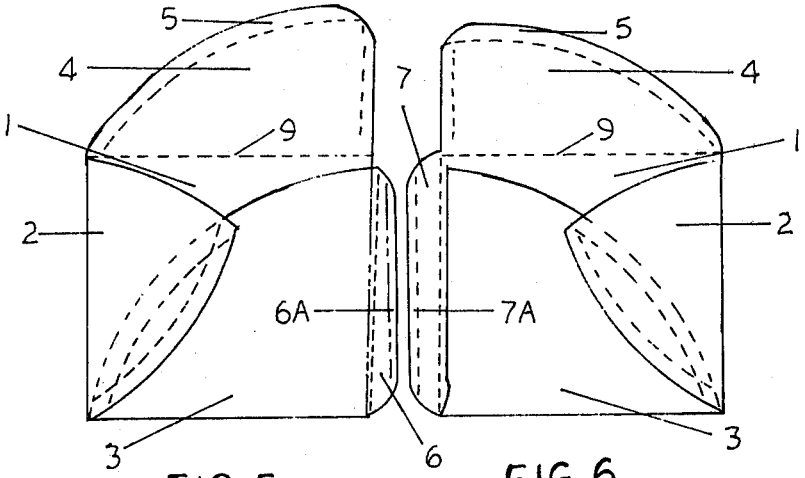
FIG. 5 is a flat view of the envelope wherein the side flap 2 of this left handed envelope has been folded forward to 180° so as to rest on the back surface of flap 3 and thus be sealed by the glued area (2A). (Folded to the right to 180°.)
FIG. 6 is a flat view of the envelope wherein the side flap 2 of this right handed envelope has been folded forward to 180° so as to rest on the back surface of flap 3 and thus be sealed by the glued area (2A). (Folded to the left to 180°.)
Figure 7:
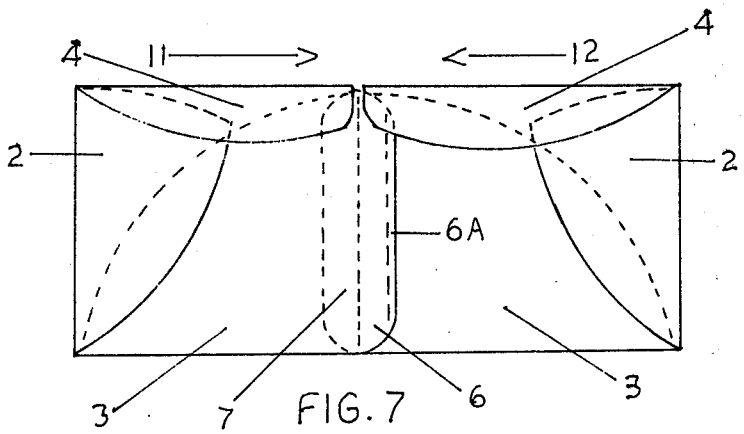

FIG. 7 is a flat view of the two completed envelopes (the left handed and the right handed) thus joined together so as to make the one double length envelope where the one right handed envelope FIG. 6, has been placed inside the other left handed envelope at the sealed or closing area of (7 and 7A) wherein the sealing flap (6 and 6A) of the left handed envelope will seal its sealing flaps (6 and 6A) and 13 so that the sealing flaps (6 and 6A) of the left handed envelope will seal to the back surface end area of flap 3 on the other right handed envelope wherein the glued inside area of this left handed envelope 13 will seal to the back side of the base area 1 to the right handed envelope. Wherein the two top sealing flaps (4 and 5) will both fold forward to 180° to seal and close said seal area 5 to the back of each said envelope to the said back areas (2 and 3).

Figure 8:
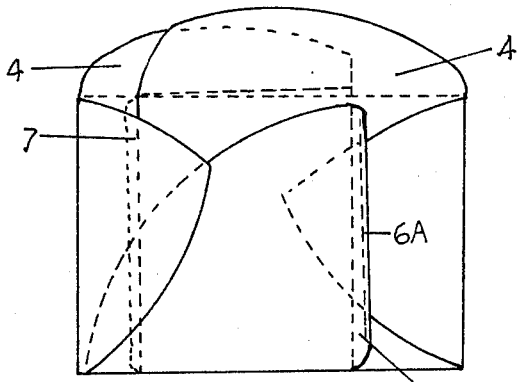

FIG. 8 is a flat or front view of the two envelopes, the left and the right handed, thus connected so as to construct the one envelope assembly that is larger than the one envelope and that is smaller than the maximum size (FIG. 7) wherein these two envelopes will adjust to any size in length, the smallest size thus being the length of the one envelope and the largest or longest size thus being the length of the two combined envelopes thus put together.

Be it noted that the left handed envelope will be of the same width as that of the right handed envelope, but the length of the left handed envelope will be shorter or less than the length of the right handed envelope so as to provide two sizes of envelopes which can be connected adjustable to form various size lengths of envelopes.

Referring to the drawings in detail, and more particularly to FIGS. (1 and 2) at this time, the reference numeral 1 represents the base area of a pre-cut piece of paper thus cut in the design of the un-folded envelope (FIG. 1 and FIG. 2) wherein this base front area will become the inside back area of the front of the envelope when folded and sealed, wherein this base area 1 is creased so as to be folded at the bottom edge 10 so as to permit the lower flap or wing 3 to be folded forward to 180° so as to rest this bottom wing flap 3 to the front of the base area 1 wherein in the left handed envelope the base area 1 is creased at the left side area 8 so as to permit this left side flap 2 to be folded forward to 180° to seal the glued area (2A) to the now back or front view side of the folded flap 3, wherein the top area of the base area 1 is creased 9 so as to permit the top sealing flap (4 and 5) to be folded forward to 180° so as to seal this top flap 4 at the glued area 5 to the bottom 3 and the left strap 2 that have been folded so as to seal this top sealing flap, wherein the back area of the base 1 has the peel away glued surface area 13 so as to be removed and thus the side sealing flap will be folded backward to 180° so as to seal this side sealing flap (6 and 6A) at the glued back area of the base area 13 wherein this will complete the folding of the one left handed envelope assembly.

Figures 1, 2, 3, 4:
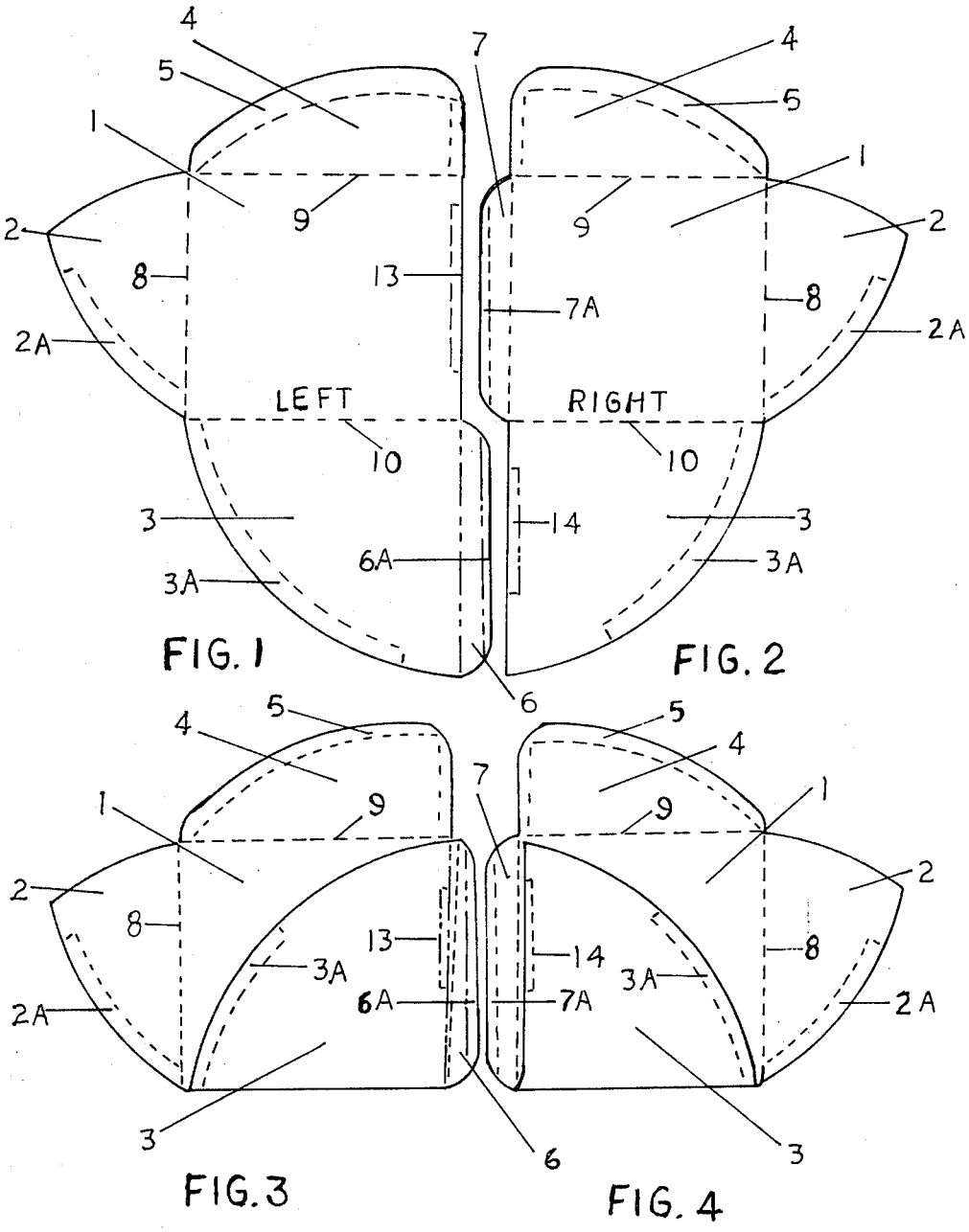
FIG. 3 is a flat view of the envelope wherein this left handed envelope has the lower flap 3 folded forward to 180° so as to rest this flap on the base surface area 1.
FIG. 4 is a flat view of the envelope wherein this right handed envelope has the lower flap 3 folded forward to 180° so as to rest this flap on the base surface area 1.

Referring now to the right handed design of the other envelope (FIG. 2) wherein the bottom wing flap (3 and 3A) will also fold forward to 180° to rest on the base area 1 and wherein this right side wing flap (2 and 2A) will fold to the left to 180° so as to connect the folded down bottom flap 3 and thus seal on this area at area (3A) and thus the envelope is complete. To seal the right handed envelope as the one complete envelope, the top sealing flap (4 and 5) are folded forward to 180° so as to seal this flap to the two sealed flaps (2 and 3) back areas with the glued area of the top flap 5 wherein the base left side has the creased sealing flap area (7 and 7A) so as to permit this side sealing flap to be folded forward to 180° so as to sealed to the left side of the now bottom folded flap 3 so as to be sealed by the glued areas (7A and the peel away glued area 14, wherein this will complete the sealing of said right handed envelope assembly (FIG. 2).

Be it noted that the left handed envelope will contain the one dual peel off glued area 13 which is constructed on both sides of the base area 1 at this sealing area, this said dual peel-off glued area 13 will allow this envelope to join and seal connect with the other right handed envelope.

Be it noted that the right handed envelope will contain the one dual peel-off glued area 14 which is constructed on both sides of the flap area 3 at this sealing area, this said dual peel-off glued area 14 will allow this envelope to join and seal connect with the other left handed envelope.

These two complete envelopes can thus be connected as per FIG. 7 to form the maximum length or they can be adjusted as to the length as per FIG. 8 as shown by the arrows of direction (11 and 12).

It is suggested that the left handed envelope 9 inches wide and about 12 inches long.

It is suggested that the right handed envelope about 9 inches wide and about 8 inches long. Thus these two envelopes will contain a item of about 9 inches in width and up to a maximum length of about 20 inches, thus the adjustable capacity of the total of about 12 inches.

Be it noted that the area of the envelopes that which contains the addresses is not shown but is understood to be the other side of the base 1 as per FIGS. 1 and 2.

While various changes may be made in the detail construction, it understood that such changes will be within the spirit and scope of the present invention as defined by the claims:

What is claimed is:

1. An adjustable envelope assembly comprising two complementary sections, each of said sections having a four-sided flat base surface with bottom, top and first end flaps attached on three sides thereto, said top flaps each having seals along their entire periphery, said end and bottom flaps having seals along only part of their respective peripheries, one of said sections having a sealing end attached to said bottom flap, the other of said sections having an end sealing flap attached to the base flap along its fourth side, each of said sections individually sealable and capable of use as complete envelopes, said bottom and first end flaps of each of said sections folded over said base surface and sealed to each other, one of said sections telescopically engaged within the other of said sections, along said fourth side, said two sections attached by said sealing end.

* * * * *